United States Patent [19]

Ide

[11] Patent Number: 5,048,981

[45] Date of Patent: Sep. 17, 1991

[54] MODULAR DROP-IN SEALED BEARING ASSEMBLY FOR DOWNHOLE DRILLING MOTORS

[76] Inventor: Russell D. Ide, P.O. Box 744, 641 Arnold Rd., Coventry, R.I. 02816

[21] Appl. No.: 571,928

[22] Filed: Aug. 24, 1990

[51] Int. Cl.[5] ..... F16C 33/76; E21B 4/02

[52] U.S. Cl. ..... 384/607; 175/107; 277/3; 277/85; 384/479

[58] Field of Search ..... 384/92, 94, 97, 607, 384/477, 479; 277/3, 27, 85, 135; 175/107

[56] References Cited

U.S. PATENT DOCUMENTS

| | | | |
|---|---|---|---|
| 3,666,333 | 5/1972 | Dicky | 384/479 |
| 3,866,988 | 2/1975 | Striegler | 384/479 X |
| 4,114,703 | 9/1978 | Matson, Jr. et al. | 384/479 X |
| 4,284,149 | 8/1981 | Fox | 175/107 X |
| 4,320,929 | 3/1982 | Clark et al. | 384/607 |
| 4,476,944 | 10/1984 | Beimgraben | 175/107 X |
| 4,577,704 | 3/1986 | Aumann | 175/107 |
| 4,593,774 | 6/1986 | Lingafellow | 384/607 X |
| 4,665,997 | 5/1987 | Maurer et al. | 175/107 |

*Primary Examiner*—Thomas R. Hannon
*Attorney, Agent, or Firm*—Marks Murase & White

[57] ABSTRACT

A sealed bearing assembly for downhole drilling motors, which has a modular drop-in type construction. The sealed bearing assembly includes a housing portion which is secured to the drilling shaft and a housing portion which is secured to the casing. A bearing assembly extends between the two housing portions and the housing portions encase the bearing assembly and include a sealed construction which prevents the entry of drilling mud into the sealed assembly. A number of flow passages are provided in the rotating housing portion and/or the stationary housing portion so as to allow fluid to freely pass the sealed bearing assembly such that there is a negligible pressure drop across the sealed bearing assembly. The assembly also includes sealing portions on either side of the bearing assembly which preclude the entry of mud into the sealed bearing assembly. The sealing portions include a reservoir for pressurizing lubricating oil to at least the pressure of the drilling mud and causing the pressurized oil to lubricate the bearing and other components such as a mechanical face seal and then to provide a pressure to the inner end of a backup seal at either end of the assembly so as to prevent the flow of pressurized mud across the backup seal.

20 Claims, 5 Drawing Sheets

MODULAR DROP-IN SEALED BEARING ASSEMBLY FOR DOWNHOLE DRILLING MOTORS

FIELD OF THE INVENTION

This invention relates to high pressure progressive cavity downhole drilling apparatus which are driven by high pressure drilling fluid commonly referred to as "mud" and, more particularly, to a modular sealed bearing assembly for use in such apparatus.

BACKGROUND OF THE INVENTION

Directional drilling is commonly accomplished by use of a progressive cavity motor that is located beneath the surface and driven by high pressure fluid or "mud".

Progressive cavity motors typically have a single shaft in the shape of one or more helices contained within the cavity of a flexibly-lined housing. The lined cavity is in the shape of two or more helices (one more helix than the shaft) with twice the pitch length of the shaft helix. Either the shaft or the housing is secured to prevent rotation; the part remaining unsecured rolls with respect to the secured part. In so rolling, the shaft and housing form a series of sealed cavities which are 180 apart. As one cavity increases in volume, its counterpart cavity decreases in volume exactly at the same rate. The sum of the two volumes is therefore constant. By pumping high pressure drilling fluid or "mud" into the wall casing and through the progressive cavity motor, the rotor can be caused to rotate so as to cause a progression of cavities which eventually allows the fluid to exit the progressive cavity device.

When used for directional drilling, the pump rotor is connected by a flexible coupling to a drill bit drive shaft. The drill bit drive shaft, in turn, drives the drill bit to effect drilling.

Radial and thrust bearings are typically located along the drive shaft to properly position the drive shaft and to react (absorb) radial and vertical loads. A flow restricter is also located along the drive shaft to direct the mud exiting the progressive cavity motor into an internal drive shaft passage and ultimately through the nozzles in the drill bit to flush drilling debris away from the drill bit and carry the debris back to the surface. The flow restrictors may be positioned anywhere along the drive shaft; however, they should operate to minimize flow through the bearing cavity.

In most drilling motors, the bearings are lubricated by the drilling mud. However, the mud is typically somewhat abrasive; consequently, its use as a lubricant causes the bearings to wear relatively quickly requiring costly changes of bearings in the field. A sealed oiled lubricated bearing assembly would greatly extend bearing life.

There have been several attempts at sealing an oil filled bearing system. The primary approach has been to equalize pressure across the seals such that the seals operate to separate the oil from the mud rather than also sealing against differential pressures. U.S. Pat. No. 4,593,774 to Lingafelter discloses a down hole bearing assembly which includes a two volume, three seal arrangement that allows the inner seal to be lubricated by oil and react the pressure differential. The outer two seals have no differential pressure and seal against abrasives only.

U.S. Pat. No. 4,577,704 to Auman discloses a bearing system for a down hole motor which uses a flow passage from the high pressure internal passage to the low pressure side of the bearing to eliminate the pressure across these seals. This communication path could cause catastrophic results if the passage increased sufficiently to eliminate the pressure drop across the bit.

While prior art systems such as those mentioned above, have met moderate success none of them have been entirely successful. Among other things, they do not take into account all operating conditions down hole. As a result, known sealed bearing constructions typically include one or more design features which have proven to be disadvantageous. In a number of known constructions, notably the Auman patent discussed above, fluid flow paths are provided between the internal drive shaft passage (high pressure side) and the exterior of the drive shaft after the drill bit nozzles (the low pressure side). As fluid flows through these passages, the path can become eroded and mud flow to the drill bit can be cut off causing failure of the drill bit. Other known constructions fail to adequately accommodate drive shaft deflections caused by large side loads on the drill bit. In such cases, significant shaft deflection can cause seal run out and early failure. Further, many known pressure equalization systems which, according to design, should not allow leakage of mud into the bearing assembly, in practice have been found to under certain conditions, permit mud to enter the sealed assembly. A number of known assemblies include elements in sliding contact with one another. Naturally, these constructions tend to wear relatively quickly. Additionally, in some known constructions the seal is not properly located and restrained in both the radial and longitudinal directions and as a result, the faces of the seal separate. Also, many known constructions do not include a backup seal or an exclusion seal. Another problem experienced in downhole drilling arises from the occasional need to replace bearings in the field. It can easily be appreciated that changing a bearing assembly which operates hundreds or thousands of feet below the surface is always complicated and expensive. Such field changes are further complicated by the complex multi-part construction of many known bearing assemblies. While a long lasting bearing assembly would reduce the frequency of such field changes they would still be necessary from time to time. Thus, for sometime, there has been a need for an oil filled bearing system that can be readily field changed.

SUMMARY OF THE INVENTION

The present invention alleviates the problems experienced in prior designs. Specifically, the present inventor has determined that to ensure optimum performance a sealed bearing assembly should take a number of factors into account. First, paths from the high pressure side (internal drive shaft) to the low pressure side (after the drill bit nozzles) should be avoided. If the paths become eroded, mud flow to the drill bit is cut off causing failure of the drill bit. Second, the drive shaft in prior art constructions, tends to deflect because of the large side loads on the drill bit. This deflection causes seal runout and early failure. Third, although not necessary, it is desirable that a slight positive pressure be developed in the oil reservoir such that any leakage between the seal bearing assembly and its environment is outward from the seal bearing assembly. In other words, if there is any leakage at all, it should be leakage of the oil out of the sealed bearing assembly rather than leakage of mud into the sealed bearing assembly. Fourth, it is preferred to avoid sliding contact between elements within the oil reservoir of the sealed bearing assembly because sliding elements can wear quickly. Thus, a flexible bladder is the preferred method of establishing an oil reservoir rather than a sliding piston which may wear. Fifth, the seal must be located and restrained in both the radial and longitudinal directions to prevent separation of the sealing faces. Sixth, a back-up seal is always preferred; this back-up seal also acts as an exclusion seal. Finally, a modular construction is more well suited to ready field replacement.

The present invention is a sealed bearing unit that has a large by-pass flow channels to cause negligeable pressure drop across the assembly. A separate flow restricter provided to minimize flow and to affect the required pressure drop. The sealed bearing assembly of the present invention requires no communication path between the high and low pressure sides. The small flow through the flow channels serves to cool the bearing/seal assembly. The sealed bearing assembly may also include other advantageous features such as a back-up seal assembly, an oil reservoir to replenish oil leaking across the seal, this oil reservoir may be either a flexible bladder or a sliding piston however, a bladder is preferred. The bearing assembly may also include an oil reservoir construction which provides positive pressure to the bearings. The assembly may also include a means for flexibly separating the seals from the shaft deflections. The assembly can also include an integral bearing-/seal assembly that locks the two faces of the seal into proper relationship. Finally, the seal can have a modular design for easy field replacement.

Thus, the present invention provides a sealed bearing assembly for use in combination with a downhole drilling apparatus which includes a drill bit drive shaft having a cylindrical passageway formed therein, a casing surrounding and spaced from the drive shaft to define an annular fluid passageway, and a flow restrictor arranged in the annular passageway so as to restrict fluid flow through the annular passageway thereby causing fluid to flow into the cylindrical passageway formed in the shaft.

The sealed bearing assembly includes a housing assembly extending between the drive shaft and the casing. The housing assembly includes a radially outer cylindrical wall, a radially inner cylindrical wall and two axial end walls. The outer cylindrical wall is part of a rotatable portion secured to the drive shaft. The inner cylindrical wall is part of a static portion secured to the casing. A seal end extending between the rotatable portion and the static portion is provided at each axial end to inhibit the flow of fluid between the outer cylindrical wall and the inner cylindrical wall. Each seal has an axially outer end sealing the space between the rotatable and static housing portions and an axially inner end in the interior of the housing assembly.

A plurality of fluid flow passages extend through the static housing portion and/or the rotatable housing portion. The flow passages allow fluid to flow past the sealed bearing assembly with little or no pressure drop.

A bearing assembly extends between the outer cylindrical wall and the inner cylindrical wall so as to support the rotatable housing portion on the static housing portion for rotation relative to the static housing portion. The bearing assembly may be of conventional construction.

One or more fluid reservoirs are provided at each axial end of the sealed bearing assembly. A fluid tight fluid bladder separates the fluid reservoir into an axially inner portion and an axially outer portion. The outer portion is adjacent an axial end of the housing assembly. A supply of lubricating fluid fills the inner portion of the fluid reservoir.

At least one port is formed in each axial end of the housing assembly. The port allows pressurized drilling fluid to pass from the exterior of the sealed assembly to the outer portion of the reservoir so as to fill the outer reservoir and pressurize the lubricating fluid through the flexible barrier.

A passageway system is provided on each axial side of the bearing assembly for directing pressurized lubricating fluid from the inner portion of the reservoir through the bearing assembly and against the inner end of the seal at the axial end of the housing.

Preferably, the sealed bearing assembly includes a mechanical face seal provided within the housing assembly at each axial end of the bearing assembly for inhibiting flow of fluid axially out of the bearing assembly. The sealed bearing assembly can also include positive pressure generating means for giving the lubricating oil a pressure greater than the pressure of the exterior fluid. The sealed bearing assembly also preferably includes an annular flange extending radially inward from the inner cylindrical wall to the shaft and/or an annular flange extending radially outward from the outer cylindrical wall to the casing; the fluid flow passages are formed in the annular flanges. The sealed bearing assembly can also include means for isolating the axial ends of the housing assembly from deflections of the drive shaft.

The sealed bearing assembly of the present invention can be assembled as a single module or unit which can be easily replaced. This modular or unitary construction is made possible by the fact that the assembly includes relatively movable housing portions 12 and 13 in a single unit. To effect a field change it is only necessary to remove the old bearing assembly and install the new bearing by securing the static housing portion 12 to the casing 7 and the rotatable housing portion 13 to the drive shaft 5. Any known connector can be used for this purpose. Of course, the use of easily releasable connectors facilitates field changes. In this way, the entire sealed bearing assembly can be assembled at a remote location (such as a manufacturing facility) and simple secured into place or "dropped in" in the field. This not only reduces the complexity of field changes, it reduces down time.

DETAILED DESCRIPTION OF THE DRAWINGS

Figure 1:
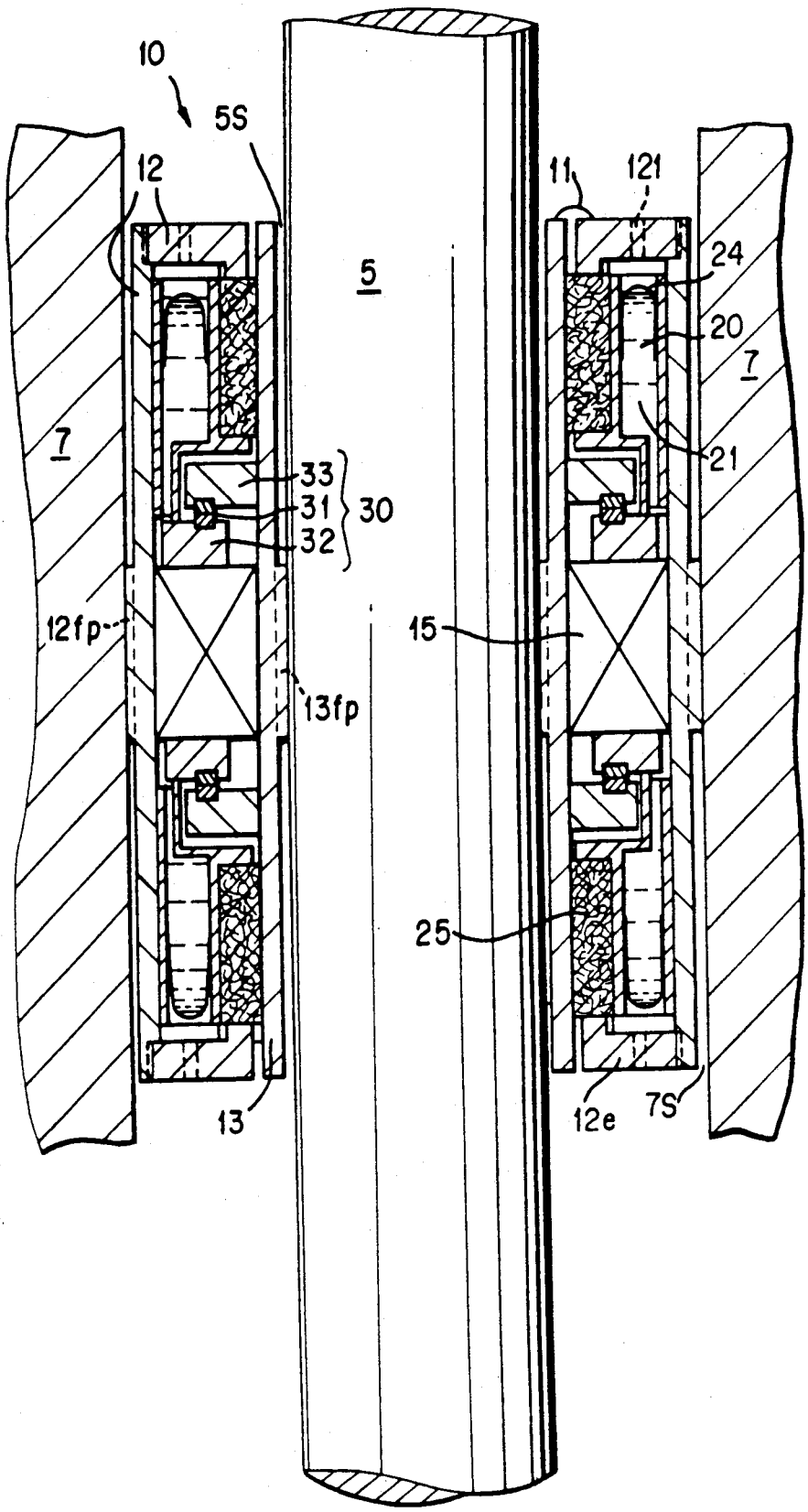
FIG. 1 is a longitudinal cross-sectional view of a first embodiment of the sealed bearing assembly of the present invention.
Figure 1A:
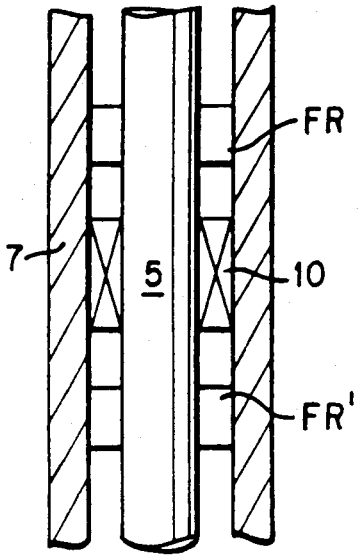
FIG. 1A is a schematic view illustrating the environment in which the sealed bearing assembly of the present invention operates.

FIG. 1 is a longitudinal cross-sectional view of a first embodiment of the sealed bearing assembly of the present invention. Since, as discussed below, the sealed bearing assembly of the present invention is not intended to function as a flow restrictor, it should be used in conjunction with one or more flow restrictors provided either upstream or downstream of the sealed bearing assembly. FIG. 1A shows possible locations of flow restrictors FR and/or FR' in relation to the sealed bearing assembly 10. Any known form of flow restrictor can be used. Presently, it is believed that good results can be obtained through the use of the flow restrictor described in applicant's copending application Ser. No. 07/454,949 entitled "High Pressure Downhole Progressive Cavity Drilling Apparatus with Lubrication Flow Restrictor", now abandoned.

As shown in FIG. 1, the sealed bearing assembly, generally indicated at 10, surrounds and supports a drill bit drive shaft 5 for rotation within a casing 7. The sealed bearing assembly 10 includes a housing 11. The housing 11 includes a static housing portion 12 which is secured to the casing 7 so as to remain stationary therewith and a rotatable housing portion 13 which is secured to the drill bit drive shaft 5 for rotation therewith. A bearing assembly generally indicated at 15 extends between the rotatable housing portion 13 and the static housing portion 12 to provide radial and thrust support for the drill bit drive shaft 5 on the casing 7. Identical sealing sections or portions, detailed below, flank the bearing assembly 15.

Any known type of bearings may be used in the bearing assembly 15. Presently, it is common practice to use rolling element, typically ball, bearings for the thrust and radial support. It is also possible to use hydrodynamic bearings, particularly the present inventor's beam mounted hydrodynamic bearings.

As indicated in FIG. 1, the inner wall of the static housing portion 13 in the region of the bearing extends completely between the bearing and the drill bit drive shaft. Similarly, the outer wall of the static housing portion 12 extends completely between the bearing assembly 15 and the casing 7. This is necessary in order to enable support of the drive shaft 5 in the casing 7. On the other hand, it should be noted that the remaining portions of the sealed bearing assembly, i.e., the sealing sections, are spaced from the drive shaft 5 and the casing 7. Specifically, there is a annular space 5S between the sealing sections of the rotatable housing portion 13 and the drill bit drive shaft 5 and an annular space 7S between the sealing sections of the static housing portion 12 and the casing 7. The provision of these annular spaces 5S, 7S, allows the sealing sections of the assembly 10 to be isolated from the deflections of the shaft which cause deterioration of the seal in known sealed bearing assemblies. It is possible to construct the assembly with only one annular, i.e., either 5S or 7S but not both, however the illustrated embodiment is believed to provide the best results.

Figure 3A:
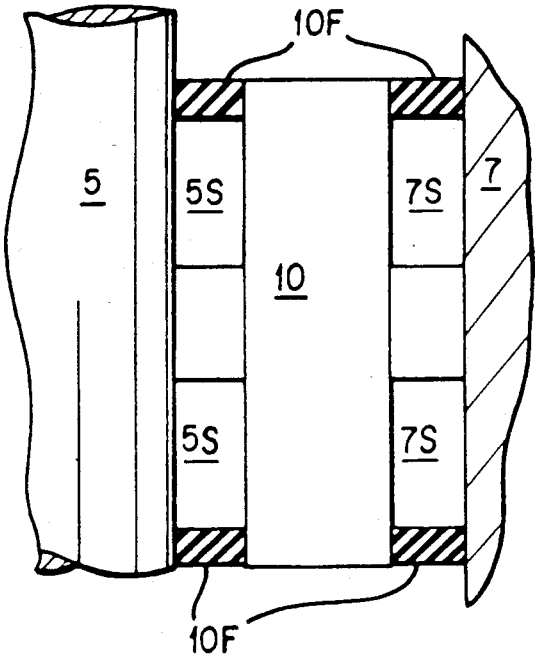
FIG. 3A is a somewhat schematic side view of the sealed bearing assembly of FIG. 3 with separate isolating elements.

While spacing the sealing portions of the assembly 10 from the shaft and casing is an ideal way of isolating these sections from shaft deflections, in some cases it could cause instability. In such cases, other means such as a flexible connection, an elastomeric mount or the like could be provided to isolate the sealing sections from the shaft motion. An example of a construction is illustrated, somewhat schematically, in FIG. 3A wherein the isolating elements 10F may be of any known type. Naturally, the isolating elements 10F must include fluid passages for the same reason that flow passages are provided in the sealed bearing assembly 10.

Figure 2:
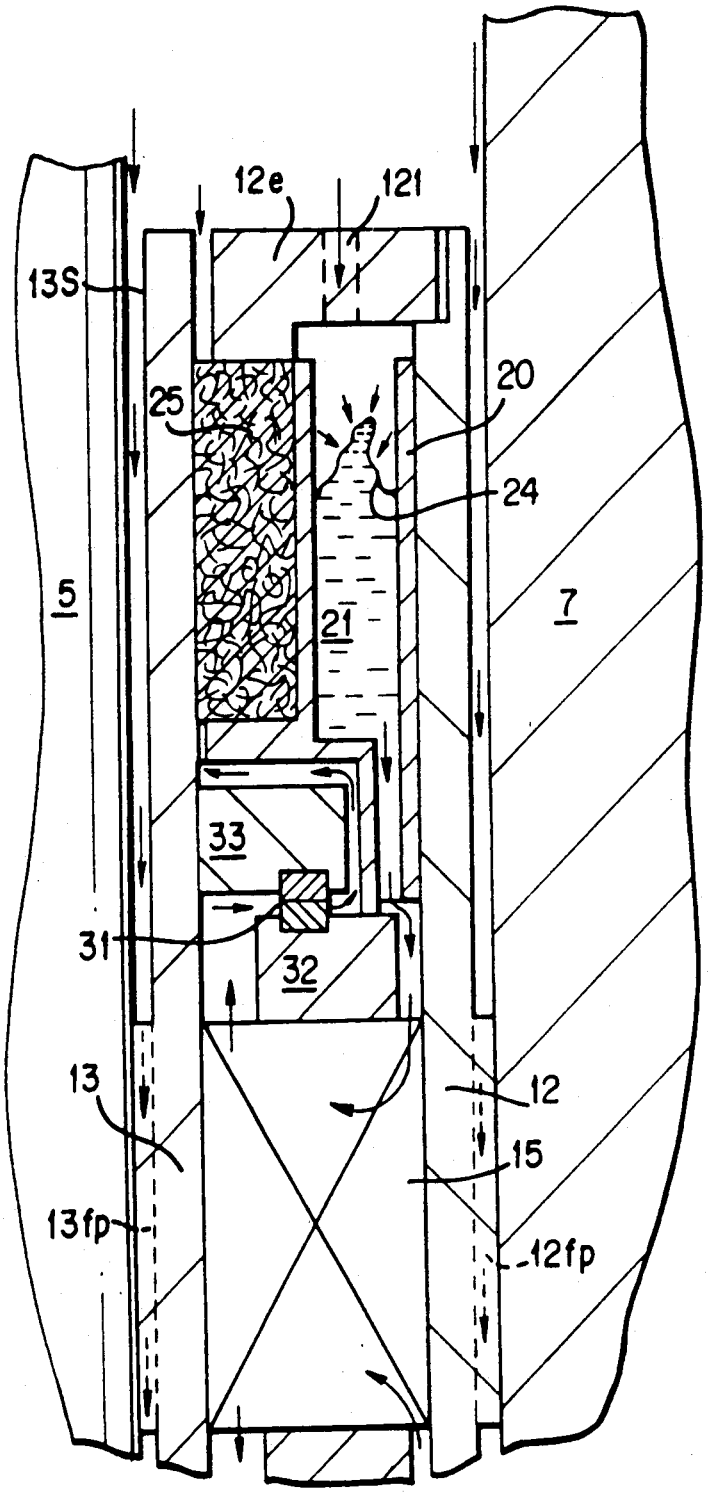
FIG. 2 is a cross-sectional detail view of a representative portion of the sealed bearing assembly of FIG. 1.

As indicated above and shown in FIG. 1, a sealing section is provided on either side of the bearing assembly 15. The construction of the sealing section above the bearing assembly is identical to that of the sealing section below the bearing assembly. Hence, the detail view of FIG. 2 shows only the upper sealing section, it being understood that the lower section has an identical construction.

In order to allow flow past the sealed assembly 10 with a negligible pressure drop, relatively large flow passages are provided between the sealed bearing assembly 10 and the drill bit drive shaft 5 and/or the casing 7. While it is not necessary to provide flow passages on both radial sides of the assembly 10, this yields maximum flow past the assembly. Thus, in the embodiment illustrated in FIG. 1, flow passages 13*fp* are provided in the radially inwardly protruding portion of the rotatable housing portion 13 and flow passages 12*fp* are provided in the radially outwardly protruding portion of the static housing portion 12. The provision of these flow passages 13*fp*, 12*fp* allow the mud flow to bypass the sealed bearing assembly 10 with a negligible pressure drop across the assembly. The flow of mud past the assembly 10 also serves to cool the assembly 10.

As noted above, the assembly described herein is intended to be used in conjunction with a separate flow restrictor provided upstream and/or downstream of the assembly to obtain the necessary pressure drop and to direct fluid into an interior passage (see FIGS. 3B and 4) formed in the drive shaft 5. This, as well as the provision of the flow passages, serves to minimize the pressure drop across the sealed bearing assembly 10. As discussed below in connection with FIG. 3 the pressure drop can be further reduced or eliminated by providing even larger flow passages.

When the pressure drop across the sealed bearing assembly 10 is minimized as described above, it is easier to provide an adequate seal for the bearing assembly because there is no significant pressure differential to be sealed against as there would be if the assembly blocked or restricted flow. The integrity of the seal provided in the sealing portions or sections of the sealed assemblies is further ensured by designing the sealing sections such that the pressure of lubricating oil within the sealed bearing assembly is equal to or greater than the pressure of the mud flowing past the assembly 10. Specifically, the sealing portions include a pressure equalization/-positive pressure construction which will be described hereinafter.

As shown in FIGS. and 2, each sealing portion includes an oil reservoir 20, a back up seal or packing 25 and a mechanical face seal assembly 30.

In the illustrated embodiment, the oil reservoir has a stepped annular shape. More specifically, the annular reservoir 20 has a cylindrical outer wall and a cylindrically stepped inner wall such that the radial dimension of the inner end of the reservoir (the end of the reservoir closest to the mechanical face seal assembly 30 as shown in FIG. 1) is smaller than the outer end of the reservoir. The reservoir 20 also includes an annular flange extending radially inward from the reservoir to support the back up packing 25. The reservoir 20 is open at both its inner and outer axial ends. However, a flexible bladder 24 is provided in the large, outer, portion of the reservoir to provide a flexible fluid barrier between the outer end of the reservoir 20 and the remainder of the interior of the sealed assembly especially the face seals 30 and bearing assembly 15. Also, the radially inner wall of the inner end of the reservoir is extended to contact the mechanical face seal assembly 30 to ensure that lubricant flows in the proper direction, as discussed below. A high grade high temperature lubricating oil 21 such as turbine oil or a synthetic is stored in the reservoir 20 on the inner side of the bladder 24 as shown.

As shown in FIG. 1, an end wall portion 12*e* (discussed below) of the static housing portion 12 is spaced a small distance from the radially outer surface of the rotatable housing portion 13. The backup packing 25 is provided to inhibit leakage of drilling mud through this space into the bearing assembly. However, since the back up packing functions as a rotating contact seal, it cannot be relied on to provide a perfect seal. As detailed below, such leakage can be completely prevented by creating a positive pressure within the lubricating fluid or simply equalizing pressure.

The backup packing 25 may be of any known form of compression packing including felt, teflon v-packing, asbestos or similar materials. In the illustrated embodiment, the packing is compressed between the aforementioned radially inward extending flange formed on the reservoir 20 and an axially extending flange formed on the radially innermost edge the static housing portion 12 as shown.

To enable proper compression adjustment and to permit assembly of the sealed bearing assembly, the two axial ends of the static housing 12 are formed as separate end wall members 12*e* of the static housing 12. Preferably, the end wall members 12*e* are threaded into the cylindrical wall portion of the static housing 12 so that the end walls 12*e* with their axially inward extending flanges can act as packing gland nuts which can be screwed in or out to adjust the compression of the backup packing 25. Of course, other forms of backup packing compression devices can be used.

The mechanical face seal assembly 30 includes a static seal surface 32, a rotatable surface 33 secured to the rotatable housing portion 13 and a face material 31. In the embodiment illustrated in FIG. the mechanical face seal is a magnetic face seal of conventional construction and the face material 31 is magnetic. It should be noted that a leak path is provided radially outward of, i.e., behind, the stationary seal surface 32 to allow the flow of lubricant to the bearing assembly 15 as discussed below.

The operation of the sealed bearing assembly of FIG. 1 is best illustrated with reference to FIG. 2 which is a detail view of a portion of the sealed bearing assembly FIG. 1 in which fluid flow is indicated by arrows. As previously mentioned, the upper and lower sealing sections or portions are identical. Consequently, it should be understood that the operation of each section is essentially identical.

As indicated above, most of the mud passing the sealed bearing assembly flows through the fluid passages 13*fp* and 12*fp* provided between the assembly 10 and the casing 7 and shaft 5. However, as previously explained, there is a small radial gap between the radially innermost edge of the end portion 12*e* of the static housing portion 12 and the radially outer surface of the rotatable housing portion 13. The mud which, notwithstanding the pressure reducing effect of the flow restrictor, is pressurized tends to enter this space. To a large extent, flow of the mud entering this space is inhibited by the backup packing 25. However, since the packing 25 moves with respect to the surface 13, a perfect seal cannot be obtained so long as there is a pressure differential tending to push mud across the back up packing into the interior of the housing. Consequently, in order to ensure that mud does not enter the housing, it is necessary to eliminate the tendency for the pressurized mud to flow into the space between the static and rotatable housing portions and through the backup packing. In accordance with the present invention, this is accomplished by pressurizing the lubricating oil to a pressure which is equal to or greater than the pressure of the mud at the interface of the backup packing 25 and the rotatable housing portion 13. If the pressure of the oil is equal to the pressure of the mud, there will be no tendency for the mud to flow through the backup packing 25 and into the bearing assembly. Such a system is termed a pressure equalization system. As an extra protection, the assembly may include means for giving the pressurized oil 21 a pressure which is slightly greater than the pressure of the mud so that the oil tends to slowly leak outward past the backup packing 25 into the mud. With such a construction, it is virtually impossible for mud to flow into the sealed bearing assembly since the pressure differential causes flow in the opposite direction. An example of such a construction which is termed a positive pressure assembly, is discussed below in connection with FIG. 3.

The embodiment shown in FIG. is a pressure equalization system. In order to obtain pressure equalization, one or more ports 121 are formed in the end portion 12*e* of the static housing 12. By virtue of the provision of such port(s) 121, pressurized mud flows through the port 121 into the open end of the reservoir 20 and against the bladder 24. The pressure of the mud acts on the bladder as schematically illustrated in FIG. 2 to pressurize the lubricating oil 21 on the other side of the bladder 24. Since the bladder 24 is flexible, an equilibrium state is achieved wherein the pressure on each side of the bladder is equal. Consequently, the lubricating oil 21 and the mud on the other side of the bladder 24 will always have the same pressure.

As indicated by the arrows in FIG. 2, the pressurized lubricating oil flows through the narrow inner end of the reservoir 20 through the aforementioned passage provided radially outward of the static face seal portion 32 and into the bearing assembly 15 to lubricate the bearing assembly in the manner known. As further indicated by arrows in FIG. 2, some of the lubricating oil flows out of the bearing assembly through a space between the rotatable housing portion 13 and the static face seal component 32. The oil 21 then flows between the face seal members 33 and 32 and across the face material 31 which, as mentioned above, is magnetic in the embodiment illustrated. After flowing across the face material 31, the pressurized oil flows between the reservoir extension and the radially outer end of the static face seal component 3 and then behind the face seal component 33 into the interface of the backup packing 25 and the rotatable housing portion 13. In this way, pressurized oil 21 having the same pressure as the mud arrives at the interface of the backup packing 25 and the static housing portion 13. Thus, at one end of the backup packing 25 there is pressurized mud and at the other end of the backup packing 25 there is pressurized lubricating oil 21. Since the two fluids have the same pressure, there is no tendency for either fluid to pass the backup packing 25. Consequently, there is no flow across the backup packing 25 and mud cannot enter the assembly 10. It is noted that the flow across the face seal is minimal. The face seal is a fluid containment element, which leaks minimal amounts of oil.

It can be seen that the present invention provides a simple yet reliable mechanism for ensuring the integrity of a sealed bearing assembly. To a large extent, the invention is made possible by the fact that the sealed bearing assembly does not act as a flow restrictor. Indeed, it is intended that a separate flow restrictor be provided. Instead of making the bearing pack a total restriction, mud is allowed to flow through the flow passages 13*fp* and 12*fp* such that there is little or no pressure drop across the bearing pack. Additionally, because of the pressure equalization arrangement described above, there is no pressure differential between the interior of the bearing assembly and the exterior of the bearing assembly. Consequently, the high pressure environment experienced downhole has no adverse effect on the sealed bearing assembly or its integrity. Also, the sealing portions are spaced from the shaft and thereby isolated from shaft deflections.

It should be understood, that the specific dimensions of the components shown in FIGS. 1 and 2, are by no means required. For instance, if it were found that larger flow passages were necessary to reduce the pressure drop across the sealed assembly, the relative dimension of the flow passages could be greatly increased. Likewise, the backup packing 25, face seal 30 and bearing assembly 15 may be of any known construction found suitable for application to the present invention. Also, the reservoir 20 can be replaced with any known fluid reservoir or by a plurality of individual fluid chambers.

From the foregoing description, it can be appreciated that the sealed bearing assembly of FIGS. and 2 can be assembled as a single module or unit which can be easily replaced. This modular or unitary construction is made possible by the fact that the assembly includes relatively movable housing portions 12 and 13 in a single unit. To effect a field change it is only necessary to remove the old bearing assembly, and install the new bearing by securing the static housing portion 12 to the casing 7 and the rotatable housing portion 13 to the drive shaft 5. Any known connector can be used for this purpose. Of course, the use of easily releasable connectors facilitates field changes. In this way, the entire sealed bearing assembly can be assembled at a remote location (such as a manufacturing facility) and simply secured into place or "dropped in" in the field. This not only reduces the complexity of field changes, it reduces down time.

In accordance with another aspect of the present invention, the bearing assembly may further include means for generating a positive oil pressure, that is a lubricating oil pressure 21 which exceeds the pressure of the drilling mud so that, as mentioned above, lubricating oil tends to flow past the backup packing 25 to insure that mud cannot leak into the bearing assembly. Of course, such a positive pressure arrangement causes a loss of lubricating oil. Consequently, it is important that the positive pressure differential not be too great so that the leaking of oil is very slow.

Figure 3B:
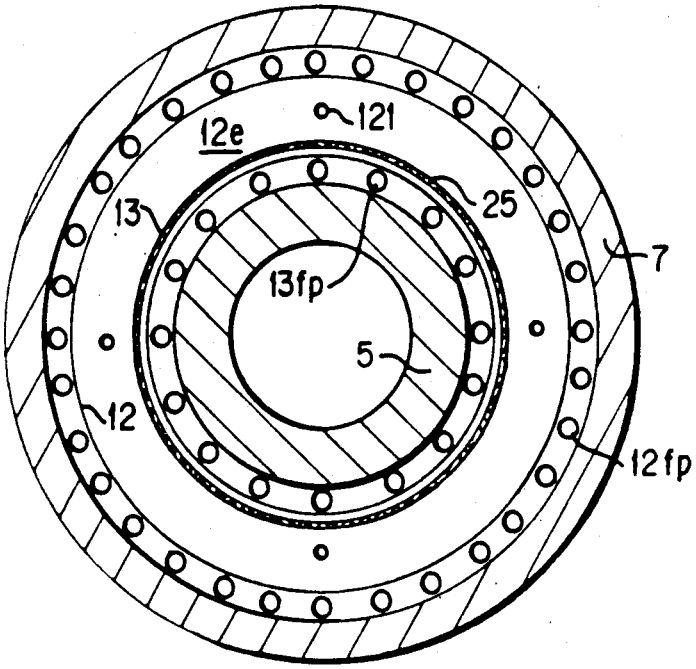
FIG. 3B is a top view of the sealed bearing assembly of FIG. 3 with axial sections of the shaft and casing.
Figure 3:
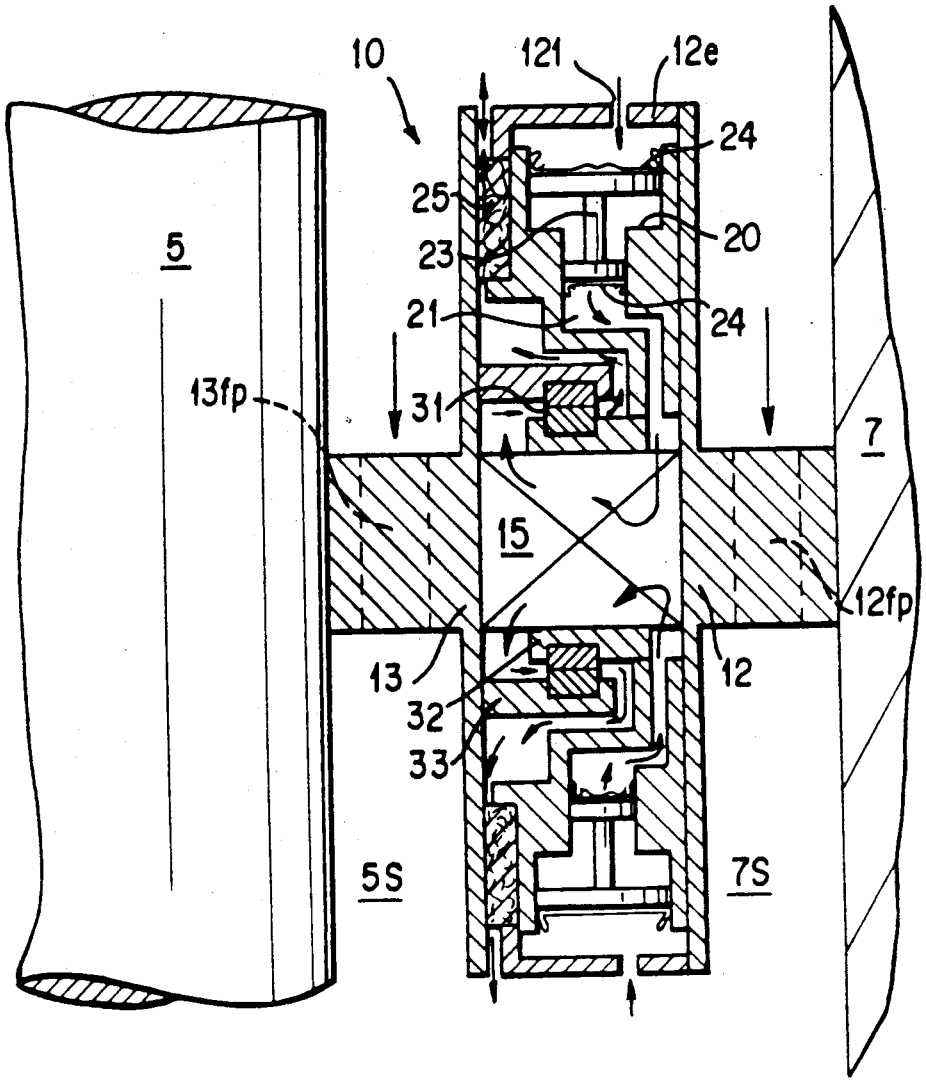
FIG. 3 is a cross-sectional partial side view of a modified sealed bearing assembly.

FIGS. 3 and 3B show a sealed bearing assembly according to the present invention which further includes positive pressure generating means. As shown in FIG. 3, the sealed bearing assembly is similar to that shown in FIG. 1 with two exceptions. First, the fluid flow passages 13*fp* and 12*fp* are significantly larger than those of the embodiment of FIGS. and 2. As mentioned above, the size of the flow passages is selected such that there is a negligible pressure drop across the sealed bearing assembly. Thus, FIGS. 3 and 3B illustrate how extremely large flow passages can be provided, if necessary. The top view of the embodiment of FIGS. 1 and 2 is similar to that shown in FIG. 3B except that the flow passages are smaller.

The second difference between the assembly shown in FIGS. 3 and 3B and that of FIGS. 1 and 2 is that the assembly of FIG. 3 includes a positive pressure generating means. Specifically, the construction includes all of the elements of the assembly of FIGS. 1 and 2, and in addition includes a sliding two head annular piston 23 and two separate flexible bladders 24 in each reservoir 20. As shown in FIG. 3 the reservoir has a cylindrically stepped construction such that the outer end of the reservoir (the end closest to the end wall 12*e* of the static housing 12) has a relatively large radial dimension and the inner end (the end closest to the bearing assembly) has a relatively narrow radial dimension. The two heads of the piston 23 slide within the respective annular portions of the reservoir 20 as shown in FIG. 3. A flexible bladder 24, is provided in each of the annular sections of the reservoir 20 as shown in FIG. 3 such that one bladder is adapted to contact the larger piston head and the other flexible bladder is adapted to contact the smaller annular piston head.

The flow of fluid through the sealed bearing assembly, as indicated by arrows in FIG. 3, is similar to that of the embodiment of FIGS. 1 and 2 and will be described in detail below. The difference is that, because of the provision of the piston 23, the lubricating oil 21 is pressurized to a pressure above that of the mud flow. Specifically, as known from the laws of hydraulics, pressure is a function of the force applied and the area over which the force is applied. Thus, the pressurized mud which flows through the port 12*e* formed in the end wall 12*e* applies a force to the larger piston head 23 through the flexible bladder 24. The force acts on the entire piston 23 including the smaller piston portion which slides in the inner annular reservoir section. When this force is applied by the smaller piston portion to the lubricating oil through the bladder 24, it acts over a smaller area. Since the same force is acting over a smaller area, the pressure, or force per unit area, is increased. Thus, the smaller piston applies increased pressure to the lubricating oil 21, so that the lubricating oil 21 has a pressure which exceeds the pressure of the pressurized mud. The pressure differential is directly related to the difference between the area of the large piston head and the area of the small piston head.

The lubricating oil pressurized by the smaller piston proceeds to flow in the same manner as the lubricating oil of the embodiments of FIGS. 1 and 2. Specifically, the oil flows through the reservoir between the static housing and the static face seal component 32 into and through the bearing assembly 15 across the magnetic face 31 of the magnetic face seal, behind the rotatable portion of the face seal 33, and to the interface of the backup packing 25 and the rotatable housing portion 13. Since the pressure of the lubricating oil 21 is greater than the pressure of the mud at the other end of the backup packing 25, the lubricating oil tends to weep across the backup packing and slowly leak out of the sealed bearing assembly. The rate of leakage depends, to some extent, upon the quality of the backup packing 25 and also depends on the pressure differential between lubricating oil and the pressurized mud. Again, the pressure differential is a function of the difference of the areas of the large and small piston heads. Since it is desirable to obtain positive pressurization but not too much of a pressure differential, the smaller piston head should be only slightly smaller in area than the larger piston head.

From the foregoing description, it can be appreciated that the sealed bearing assembly of FIGS. 3 and 3B can be assembled as a single module or unit which can be easily replaced. This modular or unitary construction is made possible by the fact that the assembly includes relatively movable housing portions 12 and 13 in a single unit. To effect a field change it is only necessary to remove the old bearing assembly and install the new bearing by securing the static housing portion 12 to the casing 7 and the rotatable housing portion 13 to the drive shaft 5. Any known connector can be used for this purpose. Of course, the use of easily releasable connectors facilitate field changes. In this way, the entire sealed bearing assembly can be assembled at a remote location (such as a manufacturing facility) and simply secured into place or "dropped in" in the field. This not only reduces the complexity of field changes, it reduces down time.

Figure 4:
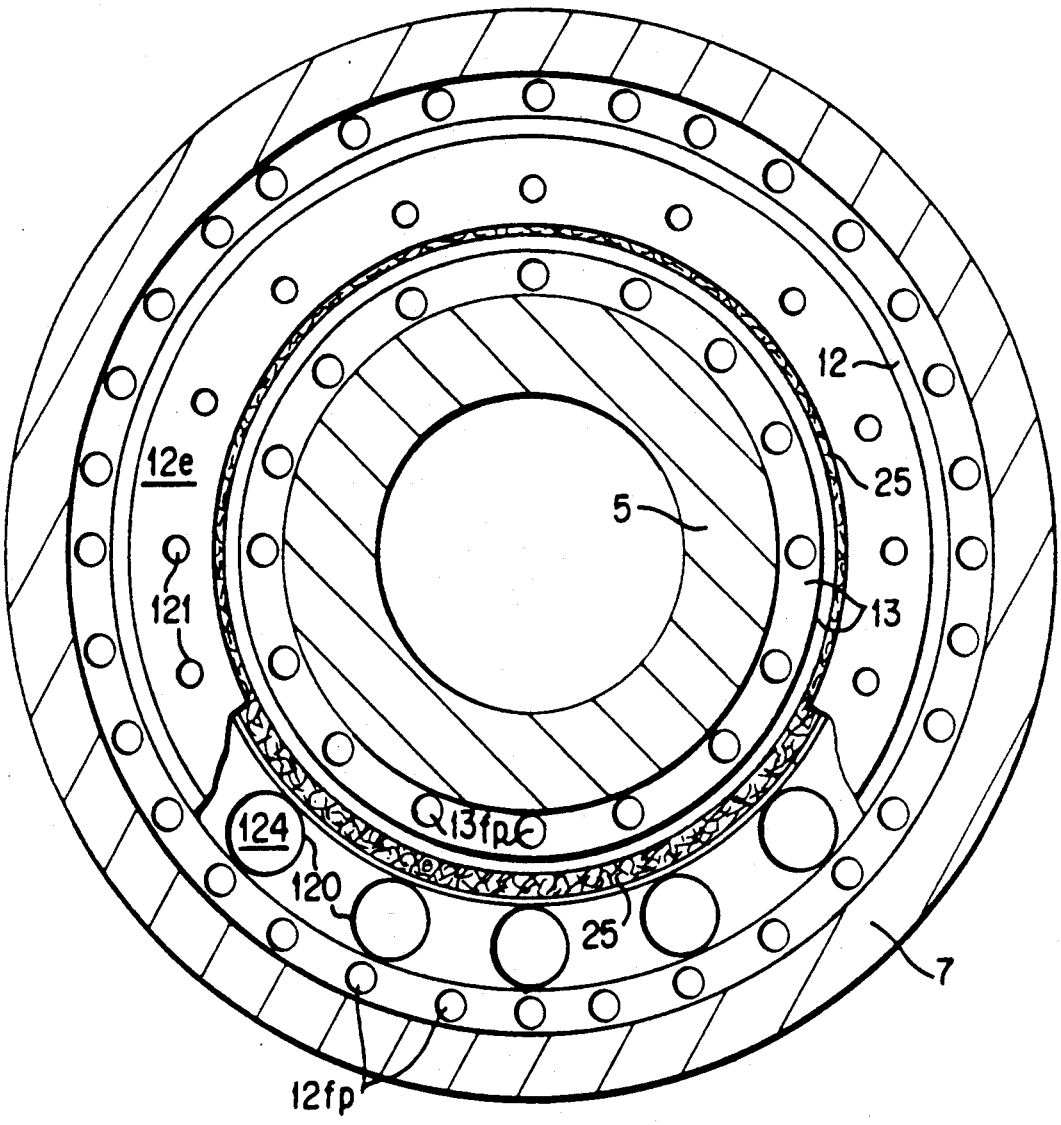
FIG. 4 is a top view of a modified sealed bearing construction with a partial cut away to show detail.

It should be understood that other variations are naturally possible. For instance, rather than using an annular reservoir, a plurality of spaced cylindrical reservoirs could be provided. FIG. 4 illustrates, somewhat schematically, an arrangement of cylindrical reservoirs 120 about the axis of a sealed bearing assembly. This modified assembly can be essentially identical to that of FIGS. 3 and 3B except that identical cylindrical reservoirs 120 are used instead of a single annular reservoir. A fluid barrier 124 such as a flexible bladder or piston head is provided in each of the cylindrical reservoirs 120. In longitudinal section, the cylindrical reservoir's pressure equalization or positive pressure construction could appear the same as shown in FIG. 1 or FIG. 3, respectively. Naturally, other forms of lubricant pressurizing constructions could be used. When using such an arrangement, it would be a simple matter to provide a dual headed piston and stepped reservoir in each of the reservoir cartridges 120. Thus, it can be appreciated that many variations are possible.

From the foregoing description, it can be appreciated that the sealed bearing assembly of FIG. 4, like the previously described constructions, can be assembled as a single module or unit which can be easily replaced. This modular or unitary construction is made possible by the fact that the assembly includes relatively movable housing portions 12 and 13 in a single unit. To effect a field change it is only necessary to remove the old bearing assembly and install the new bearing by securing the static housing portion 12 to the casing 7 and the rotatable housing portion 13 to the drive shaft 5. Again, any known connector can be used for this purpose appreciating, of course, that the use of easily releasable connectors facilitate field changes. In this way, the entire sealed bearing assembly can be assembled at a remote location (such as a manufacturing facility) and simply secured into place or "dropped in" in the field. This not only reduces the complexity of field changes, it reduces down time.

The sealed bearing assembly of the present invention offers a number of advantages over prior sealed assemblies for use in downhole drilling motors. For example, the present invention includes large bypass flow channels to cause negligible pressure drop across the assembly; a separate flow restrictor which provides the required pressure drop. Unlike some known assemblies, the present invention does not require a communication path between the high pressure fluid within the drilling shaft and the low pressure fluid outside the drilling shaft. Additionally, the flow of mud through the flow passages cools the sealed bearing assembly.

In addition to the aforementioned advantages, it is possible to provide positive pressure to the lubricating oil so that there is no possibility of leakage of mud into the sealed assembly. The assembly of the present invention also includes an oil reservoir to replenish oil which weeps across the seal. Additionally, in the present invention, the seal portions of the sealed bearing assembly are separated from, or flexibly connected to, the shaft so that they are isolated from shaft deflections. Thus, as an alternative to merely spacing the sealing portions from the shaft, the sealing portions could be resiliently mounted on the shaft or torsionally isolated in some other way. Moreover, the present invention provides an integral bearing/seal assembly that locks the two faces of the mechanical face seal into proper relationship. Most other systems have separable thrust and radial bearing sections. Finally, the present invention provides a modular unit type construction which can be easily removed and replaced in the field thus simplifying replacement of the bearings.

What is claimed is:

1. A sealed bearing assembly for supporting a drill bit drive shaft for rotation with respect to a casing in a downhole drilling motor in which drilling mud having a pressure flows between the shaft and the casing, the sealed bearing assembly comprising a static housing portion secured to the casing; a rotatable housing portion secured to the drill bit drive shaft; a bearing assembly extending between the static housing portion and the rotatable housing portion; the static housing portion and the rotatable housing portion being sealed so as to form a sealed housing assembly having an interior and encasing the bearing assembly; a plurality of flow passages extending through at least one of the static housing portion and the rotatable housing portion, said flow passages being completely separated from the interior of the housing assembly; at least one reservoir located in the sealed housing assembly, the reservoir having an outer end and an inner end and a fluid separating barrier member located in the reservoir for dividing the reservoir into an outer chamber and an inner chamber; at least one port formed in the housing assembly so as to allow the outer chamber to communicate with the exterior of the sealed housing assembly; and a lubricating oil filling the inner chamber the lubricating oil having a pressure; the fluid separating barrier member being movable in response to pressure differentials between the fluid in the outer chamber and the fluid in the inner chamber so as to cause flow of the lubricating fluid from said inner chamber through said bearing assembly.

2. The sealed bearing assembly of claim 1, further comprising a mechanical face seal on each end of the bearing.

3. The sealed bearing assembly of claim 1, further comprising a backup seal extending between the static housing portion and the rotatable housing portion, the pressure of the lubricating oil preventing flow of mud across the backup seal.

4. The bearing assembly of claim 1, further comprising positive pressure generating means in the reservoir for causing the pressure of the lubricating oil to exceed the pressure of the drilling mud.

5. The sealed bearing assembly of claim 1, wherein the sealed bearing assembly has a modular construction.

6. The sealed bearing assembly of claim 1, further comprising means for isolating the axial ends of the rotatable housing portion from deflections of the drive shaft.

7. In combination with a downhole drilling apparatus which includes a drill bit drive shaft having a cylindrical passageway formed therein, a casing surrounding and spaced from the drive shaft to define an annular fluid passageway, and a flow restrictor arranged in the annular passageway so as to restrict fluid flow through the annular passageway thereby causing fluid to flow into the cylindrical passageway formed in the shaft, a lubricated sealed bearing assembly comprising:

a housing, the housing comprising a rotatable portion secured to the drive shaft and a static portion secured to the casing; at least one of the static housing portion and the rotatable housing portion having a radially extending end wall extending toward the other housing portion and spaced from the other housing portion so as to define an annular gap between the housing portions;

a bearing assembly contained within the housing, the bearing assembly supporting the rotatable housing for rotation relative to the static housing portion; a face seal assembly provided within the housing at each axial end of the bearing assembly;

a contact seal extending across the annular gap between the housing portions to inhibit flow across the annular gap, the contact seal having an outer end in contact with the end wall and an inner end; and a pressurized oil supply assembly for supplying pressurized oil to the bearing assembly and to the inner end of the contact seal.

8. The sealed bearing assembly of claim 7, further comprising a plurality of fluid flow passages extending through at least one of the static housing portion and the rotatable housing portion, the flow passages allowing fluid to flow past the sealed bearing assembly.

9. The sealed bearing assembly of claim 7, wherein the static housing portion includes an annular flange extending radially outward and secured to the casing; a plurality of fluid flow passages extending through the annular flange, the fluid flow passages allowing fluid to flow past the sealed bearing assembly.

10. The sealed bearing assembly of claim 7, further comprising an annular flange extending radially inward, the annular flange being secured to the rotatable shaft and including a plurality of fluid flow passages extending through the annular flange, the fluid flow passages allowing fluid to flow past the sealed bearing assembly.

11. The sealed bearing assembly of claim 7, further comprising at least one of an annular flange extending radially outward and secured to the casing and an annular flange extending radially inward and secured to the drive shaft, the annular flange having an axial dimension and being arranged so as to provide solid support for the bearing assembly but to isolate the axial ends of the sealed housing from vibrations of the shaft.

12. The sealed bearing assembly of claim 11 further comprising separate means for isolating the axial ends of the housing assembly from deflections of the drive shaft.

13. The sealed bearing assembly of claim 7, wherein the pressurized oil supply assembly includes: at least one fluid reservoir within the housing at each axial end of the sealed bearing assembly; a fluid tight flexible bladder separating the fluid reservoir into an inner portion and an outer portion, the outer portion being adjacent to the axial end of the housing assembly; a supply of lubricating fluid filling the inner portion of the fluid reservoir; at least one port in each axial end of the housing assembly, the port allowing pressurized drilling fluid to pass from the exterior of the sealed housing assembly to the outer portion of the reservoir so as to pressurize the lubricating fluid through the flexible barrier; and a passageway system on each axial side of the bearing assembly for directing pressurized lubricating fluid from the inner portion of the reservoir and against the inner end of the contact seal so as to oppose the pressure of exterior fluid on the outer end of the contact seal.

14. The sealed bearing assembly of claim 13, further comprising a positive pressure means for giving the pressurized fluid lubricant a pressure greater than the pressure of the fluid on the exterior of the housing.

15. The sealed bearing assembly of claim 13, further comprising a piston in each of the fluid reservoirs, the piston having two heads of different sizes, the first piston head being acted upon by fluid in the outer reservoir portion and the second piston head acting upon the lubricating fluid in the inner reservoir portion, the second piston head having greater area than the first piston head so that the lubricating fluid has a greater pressure than the pressure drilling fluid.

16. A sealed bearing assembly for supporting a drill bit drive shaft in a casing, the sealed bearing assembly comprising:

a housing assembly extending between the drive shaft and the casing, the housing assembly comprising a radially inner cylindrical wall, a radially outer cylindrical wall and two axial end walls and the assembly including a rotatable portion, which includes the inner cylindrical wall secured to the drive shaft, a static portion, which includes the outer cylindrical wall secured to the casing and a seal at each axial end extending between the rotatable portion and the static portion to inhibit the flow of fluid between the outer cylindrical wall and the inner cylindrical wall, each seal having an axially outer end sealing the space between the rotatable and static housing portions and an axially inner end in the interior of the housing assembly;

a plurality of fluid flow passages extending through at least one of the static housing portion and the rotatable housing portion, the flow passages allow fluid to flow past the sealed bearing assembly;

a bearing assembly extending between the outer cylindrical wall and the inner cylindrical wall so as to support the rotatable housing portion on the static housing portion for rotation relative to the static housing portion;

at least one fluid reservoir at each axial end of the sealed bearing assembly, a fluid tight fluid bladder separating the fluid reservoir into an axially inner portion and an axially outer portion, the outer portion being adjacent an axial end of the housing assembly, and a supply of lubricating fluid filling the inner portion of the fluid reservoir;

at least one port formed in each axial end of the housing assembly, the port allowing pressurized drilling fluid to pass from the exterior of the sealed housing assembly to the outer portion of the reservoir so as to fill the outer reservoir and pressurize the lubricating fluid through the fluid tight barrier;

and a passageway system on each axial side of the bearing assembly for directing pressurized lubricating fluid from the inner portion of the reservoir through the bearing assembly and against the inner end of the seal at the axial end of the housing.

17. The sealed bearing assembly of claim 16, further comprising a mechanical face seal provided within the housing assembly at each axial end of the bearing assembly for inhibiting flow of fluid axially out of the bearing assembly.

18. The sealed bearing assembly of claim 16, further comprising positive pressure generating means for giving the lubricating oil a pressure greater than the pressure of the exterior fluid.

19. The sealed bearing assembly of claim 16, further comprising at least one of an annular flange extending radially inward from the inner cylindrical wall to the shaft and an annular flange extending radially outward from the outer cylindrical wall to the casing, said fluid flow passages being formed in said annular flange.

20. The sealed bearing assembly of claim 16, further comprising means for isolating the axial ends of the housing assembly from deflections of the drive shaft.

* * * * *